US009638134B2

(12) United States Patent
Kaneda et al.

(10) Patent No.: US 9,638,134 B2
(45) Date of Patent: May 2, 2017

(54) CARBURETOR

(71) Applicant: KEIHIN CORPORATION, Tokyo (JP)

(72) Inventors: Kazuki Kaneda, Shioya-gun (JP); Koji Matsuno, Shioya-gun (JP)

(73) Assignee: KEIHIN CORPORATION, Tokyo (JP)

( * ) Notice: Subject to any disclaimer, the term of this patent is extended or adjusted under 35 U.S.C. 154(b) by 53 days.

(21) Appl. No.: 14/865,324

(22) Filed: Sep. 25, 2015

(65) Prior Publication Data

US 2016/0090942 A1 Mar. 31, 2016

(30) Foreign Application Priority Data

Sep. 26, 2014 (JP) ..... 2014-196367

(51) Int. Cl.

| | |
|---|---|
| ***F02M 5/00*** | (2006.01) |
| ***F02M 11/02*** | (2006.01) |
| ***F02M 5/16*** | (2006.01) |
| ***F02M 5/12*** | (2006.01) |
| ***F02M 17/12*** | (2006.01) |
| ***F02M 7/26*** | (2006.01) |
| *F02M 1/02* | (2006.01) |

(52) U.S. Cl.

CPC ..... *F02M 11/02* (2013.01); *F02M 5/14* (2013.01); *F02M 5/16* (2013.01); *F02M 7/26* (2013.01); *F02M 17/12* (2013.01); *F02M 1/02* (2013.01)

(58) Field of Classification Search

CPC ..... F02M 11/02; F02M 5/16; F02M 17/12; F02M 5/14

USPC ..... 261/38, 42, 72.1

See application file for complete search history.

(56) References Cited

U.S. PATENT DOCUMENTS

| | | | | | |
|---|---|---|---|---|---|
| 1,933,381 | A | * | 10/1933 | Mock | F02M 5/02 261/34.2 |
| 3,342,463 | A | * | 9/1967 | Tasuku | F02M 7/17 261/44.4 |
| 4,564,482 | A | * | 1/1986 | Tahata | F02M 9/06 261/44.3 |
| 5,240,649 | A | * | 8/1993 | Yamada | F02M 7/093 261/34.2 |

FOREIGN PATENT DOCUMENTS

| | | | | |
|---|---|---|---|---|
| JP | 59201955 | A | * 11/1984 | F02M 3/00 |
| JP | 2004-137928 | A | 5/2004 | |

* cited by examiner

*Primary Examiner* — Robert A Hopkins

(74) *Attorney, Agent, or Firm* — Westerman, Hattori, Daniels & Adrian, LLP

(57) ABSTRACT

A carburetor comprises a rotation-typed control valve which opens or closes a second bleed air passage according to an opening degree of the throttle valve. The control valve includes an upper end portion of a valve stem, and in a projection plane orthogonal to an axis of an aspirating channel, a first bleed air passage is arranged on one side of the valve stem, an upstream-side passage portion starting from the control valve of the second bleed air passage is arranged on an upper side of the aspirating channel, a downstream-side passage portion starting from the control valve of the second bleed air passage is arranged on the one side of the valve stem, and a downstream end of the downstream-side passage portion is connected to a midway portion of the first bleed air passage.

4 Claims, 4 Drawing Sheets

CARBURETOR

TECHNICAL FIELD

The present invention relates to a carburetor, especially relates to a carburetor in which, a butterfly-shaped throttle valve for opening or closing an aspirating channel formed in a carburetor body is provided in said aspirating channel, a valve stem of the throttle valve being supported on the carburetor body in a flee-rotation way is provided to extend in up-and-down direction, and at an outer periphery of a main nozzle which is opened towards the aspirating channel, an air bleed chamber connecting to an interior of the main nozzle via a plurality of bleed holes is formed, said air bleed chamber being connected to a first bleed air passage which is formed in the carburetor body and is in on state and a second bleed air passage which is also formed iii the carburetor body and is opened or closed by a control valve, an upstream end of each of said first and second bleed air passages being opened towards an upstream side of said aspirating channel in the carburetor body, the storage fuel in a float chamber which is connected to the carburetor body can be sprayed into the aspirating channel through said main nozzle.

BACKGROUND

As disclosed in the following patent literature 1, there is a carburetor comprising a rotation-typed control valve, in which the second bleed air passage is opened or closed according to an opening degree of the throttle valve by a lower end portion forming with a grooving portion on a part of an outer periphery of a valve stem, thereby simplifying the structure of the control valve, and opening or closing the second bleed air passage accurately according to an opening degree of the throttle valve.

THE PRIOR ART LITERATURE

The Patent Literature (The patent literature 1) JP2004-137928

SUMMARY

In the carburetor stated in the prior art, in a case of observing from a projection plane orthogonal to an axis of the aspirating channel, on one side of the valve stem, the first and second bleed air passages are arranged along the up and down directions, and the downstream end of each of said first and second bleed air passages are directly opened towards the air bleed chamber, respectively. As a result, the first and second bleed air passages are arranged on the same one side of the valve stem along the up and down directions, such that volumes of the carburetor body expand. Furthermore, the control valve is installed on a midway portion of the second bleed air passage, which results in that a coiled path of said second bleed air passage is relatively complex and becomes longer. Therefore, there are the problems that the second bleed air passage is not easily to be processed or shaped, and the design freedom degree is limited and so on.

The present application is proposed with respect to the above problem and provides a carburetor, which can realize miniaturization of the carburetor body, process or shape the second bleed air passage smoothly, and prevent attachment or deposition of dirt, on the control valve effectively.

One aspect of the present application provides a carburetor in which, a butterfly-shaped throttle valve for opening or closing an aspirating channel formed in a carburetor body is provided in said aspirating channel, a valve stem of said throttle valve being supported on the carburetor body in a free-rotation way is provided to extend in up-and-down direction, and at an outer periphery of a main nozzle which is opened towards said aspirating channel, an air bleed chamber connecting to an interior of a main nozzle via a plurality of bleed holes is provided, said air bleed chamber being connected to a first bleed air passage which is formed in the carburetor body and is in on state, and a second bleed air passage which is also formed in the carburetor body and is opened or closed by a control valve, and an upstream end of each of said first bleed air passage and said second bleed air passage being opened towards an upstream-side of said aspirating channel of the carburetor body, such that the storage fuel in a float chamber being connected to the carburetor body can be sprayed into said aspirating channel through said main nozzle. The first features of the carburetor are in that: said carburetor comprises a rotation-typed control valve, wherein said control valve controls open/close of the second bleed air passage according to an opening degree of the throttle valve by an end portion with a grooving portion on a part of an outer periphery of said valve stem, said control valve consists of an upper end portion of said valve stem, and in a case of observing from a projection plane orthogonal to an axis of said aspirating channel, said first bleed air passage is arranged on one side of said valve stem, an upstream-side passage portion starting from said control valve of the second bleed air passage is arranged on an upper side of said aspirating channel, a downstream-side passage portion starting from said control valve of the second bleed air passage is arranged on said one side of the valve stem when observing from said projection plane, and a downstream end of said downstream-side passage portion is connected to a midway portion of said first bleed air passage.

Furthermore, in the present application, the meaning of "the valve stem is provided to extend in up-and-down direction" refers to inclusion of not only the case where the valve stem of the throttle valve is accurately vertically-arranged, but also the case where the valve stem of the throttle valve is slightly obliquely-arranged from the vertical line, as shown by arrows a, b and c in FIGS. 1 and 3.

Furthermore, the carburetor further includes the second feature, in addition to the first feature. That is, in a case of observing from said projection plane orthogonal to an axis of said aspirating channel, a slow passage is arranged on the other side of said valve stem in the carburetor body, and an injection orifice of said slow passage is opened to a portion of the aspirating channel located on downstream side of the main nozzle of said aspirating channel, such that a part of the storage fuel in said float chamber can be mixed with air, so as to be sprayed into the aspirating channel.

Further, the carburetor further includes the third feature, in addition to the first feature and the second feature. That is, a bearing hole being fitted with an upper end portion of said valve stem in a rotation-free way and performing support is formed in the carburetor body, and said upstream-side passage portion and said downstream-side passage portion of said second bleed air passage are opened towards said bearing hole, wherein each of openings, opened towards said bearing hole, of said upstream-side passage portion and said downstream-side passage portion is configured that, in a case of observing from a projection plane of the two openings orthogonal to said valve stem, the two openings are arranged next to each other in the circumferential direction of said bearing hole, and at least a part of the two openings is located at the same position along an axis direction of said valve stem.

As stated in the above, according to the first feature, the carburetor comprises a rotation-typed control valve, wherein said control valve controls open/close of the second bleed air passage according to an opening degree of the throttle valve by the end portion with a grooving portion on a part of an outer periphery of valve stem of the throttle valve, and in said carburetor, said control valve consists of an upper end portion of said valve stem. In a case of observing from a projection plane orthogonal to an axis of said aspirating channel, said first bleed air passage is arranged on one side of said valve stem, an upstream-side passage portion starting from said control valve of the second bleed air passage is arranged on an upper side of said aspirating channel, a downstream-side passage portion starting from said control valve of the second bleed air passage is arranged on said one side of the valve stem when observing from said projection plane, and a downstream end of said downstream-side passage portion is connected to a midway portion of said first bleed air passage. Thus, it does not only realize reduction of the fuel consumption and optimization of the bleed air when the engine operates with a specific load, but also by arranging the first bleed air passage on said one side of the valve stem extending in the up and down directions and arranging the upstream side passage portion of the second bleed air passage on the upper side of the aspirating path, at a periphery of the aspirating channel in the carburetor body, realize miniaturization of the carburetor body, i.e., connect the upstream side passage portion of the second bleed air passage to the upper end portion the control valve) of the valve stem at a shortest distance without efforts. Moreover, the downstream side passage portion of the second bleed air passage is arranged on said one side of the valve stem in the carburetor body, and converges with the midway portion of the first bleed air passage on the same side. Therefore, it is unnecessary to make the downstream end of the second bleed air passage prolong to the air bleed chamber and directly open towards the air bleed chamber, thus it is helpful to shorten the length of said second bleed air passage, and improve processability and formability. Moreover, attachment and deposition of dirt on the control valve due to aspiration countercurrent in the aspirating channel can be prevented effectively by arranging the upstream side passage portion of the second bleed air passage and the control valve connected to the upstream side passage portion on the upper side of said aspirating channel.

Especially, according to the second feature, in a case of observing the slow passage from said projection plane, said slow passage is arranged on the other side of said valve stem in the carburetor body, and an injection orifice of said slow passage is opened to a portion of the aspirating channel located on downstream side of the main nozzle of said aspirating channel. Thus, at a periphery of said aspirating channel in the carburetor body, the slow passage can be arranged on the other side of the valve stem extending in the up and down directions (i.e., one side opposite to the first bleed air passage with respect to the valve stem). Therefore, the slow passage can be freely arranged without efforts by fully using wall portions on the other side of the valve stem in said carburetor body, which is beneficial to further miniaturize the carburetor.

Further, according to the third feature, a bearing hole being fitted with an upper end portion of said valve stem and performing support is formed in the carburetor body, and said upstream-side passage portion and said downstream-side passage portion of said second bleed air passage are opened towards said bearing hole, wherein each of openings, opened towards said bearing hole, of said upstream-side passage portion and said downstream-side passage portion is configured that, in a case of observing from the projection plane of the two openings orthogonal to said valve stem, the two openings are arranged next to each other in the circumferential direction of said bearing hole, and at least a part of the two openings is located at the same position along an axis direction of said valve stem. Therefore, it is beneficial to miniaturize the carburetor by shrinking the bearing holes opened for both the upstream-side passage portion and downstream-side passage portion of the second bleed air passage simultaneously, and the corresponding upper end portions of the valve stem as much as possible.

DETAILED DESCRIPTION

Figure 1:
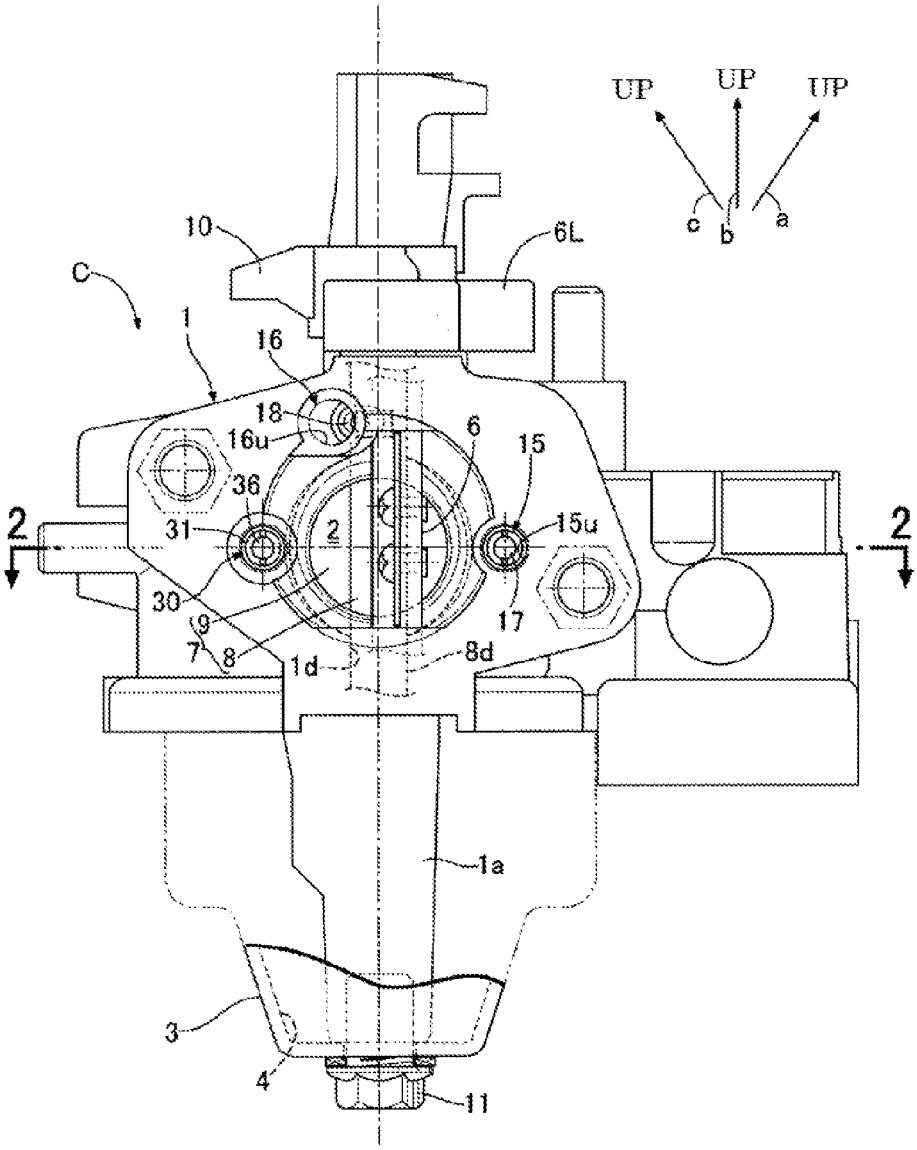
FIG. 1 is a main view obtained by observing one embodiment of the carburetor of the present invention from the aspiration upstream side.

The embodiments of the present application will be explained below with reference to the preferential embodiment shown in the drawings.

Figure 2:
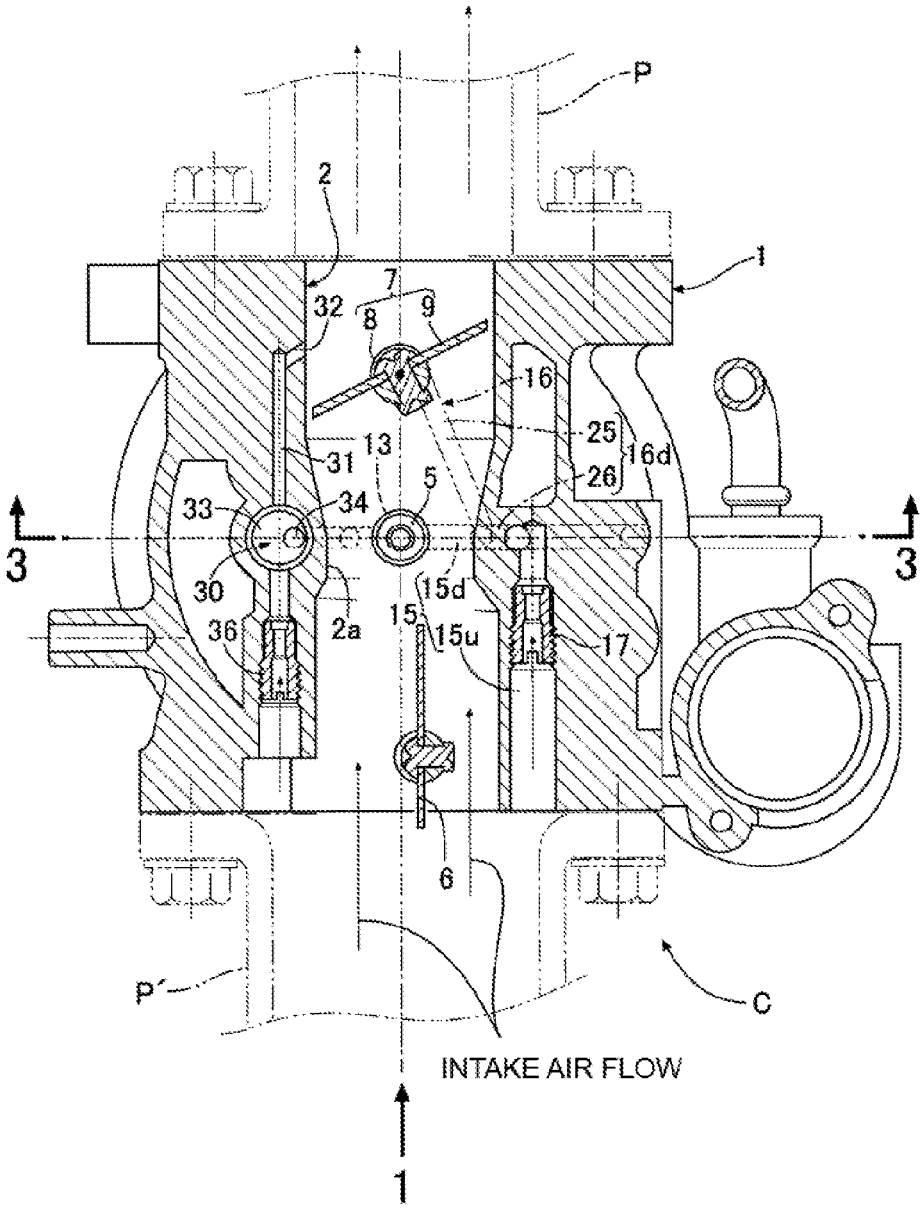
FIG. 2 is a sectional view along the line 2-2 in FIG. 1.

First, in FIGS. 1 and 2, the carburetor C is used to generate a mixed gas of air and fuel provided to the engine loaded on the dynamic working equipment (such as an activation-typed generator, a dynamic mower, etc.) not shown in the drawings. The carburetor C comprises: a carburetor body 1 including an aspirating channel 2 extending in the horizontal direction; and a float chamber body 3 engaging with a lower surface periphery of the carburetor body 1 via an O-shaped annulus 23, a float chamber 4 being formed between the float chamber body 3 and the carburetor body 1.

In the carburetor body 1, an aspirating tube P connected to a combustor of the engine is connected to the downstream-end side of the aspirating channel 2, and an aspirating tube P' connected to an air cleaner (not shown) connected to the upstream-end side of the aspirating channel 2. Furthermore, the air cleaner may be directly connected to the upstream end of the aspirating channel 2, without by the aspirating tube P'.

An upper end of the main nozzle 5 in a cylindrical shape and extending in the up and down directions is opened towards below the Venturi portion 2*a* of the aspirating channel 2. Across the Venturi portion 2*a*, a chock valve 6 is arranged on the upstream side (i.e., the lower side in FIG. 2) of the aspirating channel 2, and a throttle value 7 is arranged on the downstream side (i.e., the upper side in FIG. 2) of the aspirating channel 2. In a state where the engine operates, the air after passing through the air cleaner flows into the combustor of the engine in the aspirating channel 2 of the carburetor C, but the carburetor C at that time enables the storage fuel F in the float chamber 4 to be sprayed to the Venturi portion 2*a* of the aspirating channel 2 in a vaporific form via the main nozzle 5, so that the mixed gas is generated by mixing the storage fuel with the passed air flow.

The throttle value 7 is comprised of the valve stem 8 (valve shaft) extending in the up-and-down direction and the butterfly-shaped valve plate 9 (valve plate). The valve stem 8 penetrates through the aspirating channel 2 and is rotatably supported on the carburetor body 1, and the valve plate 9 is fixed on the valve stem 8 in the aspirating channel 2. The upper end portion 8*u* and the lower end portion 8*d* of the valve stem 8 are fitted with the upper bearing hole 1*u* and the lower bearing hole 1*d* in a rotation-free way, respectively, wherein the upper bearing hole 1*u* and the lower bearing hole 1*d* are respectively arranged in peripheral walls at right above and right below the aspirating channel 2 in the carburetor body 1. Furthermore, in the embodiment, the meaning of "the valve stem 8 extending in the up-and-down direction" refers to inclusion of not only the case where the valve stem 8 is accurately vertically-arranged, but also the case where the valve stem 8 is obliquely arranged slightly from the vertical line, as shown by arrows a, b and c in FIGS. 1 and 3.

An extended shaft portion 8*e* extending out above the carburetor body 1 is integrately connected and set on an outer end of the upper end portion 8*u* of said valve stem 8, and a throttle lever 10 is connected to the extended shaft portion 8*e*. Thus, if the throttle lever 10 is operated (the valve stem 8 is correspondingly operated) to make it rotate, the aspirating channel 2 can be opened/closed by the valve plate 9 which rotates commonly with the throttle lever 10 and the valve stem 8. Furthermore, by manual, said throttle lever 10 can also be kept at an arbitrary rotation operation position by a hold mechanism arranged between the throttle lever 10 and the carburetor body 1, or by a hold mechanism arranged between the throttle lever 10 and other devices including a universal machine. In addition, a chock level 6L for arbitrarily rotationally operate the upper end portion of the valve stem of said chock valve 6 is fixedly connected to the upper end portion of the valve stem of said chock valve 6.

Figure 3:
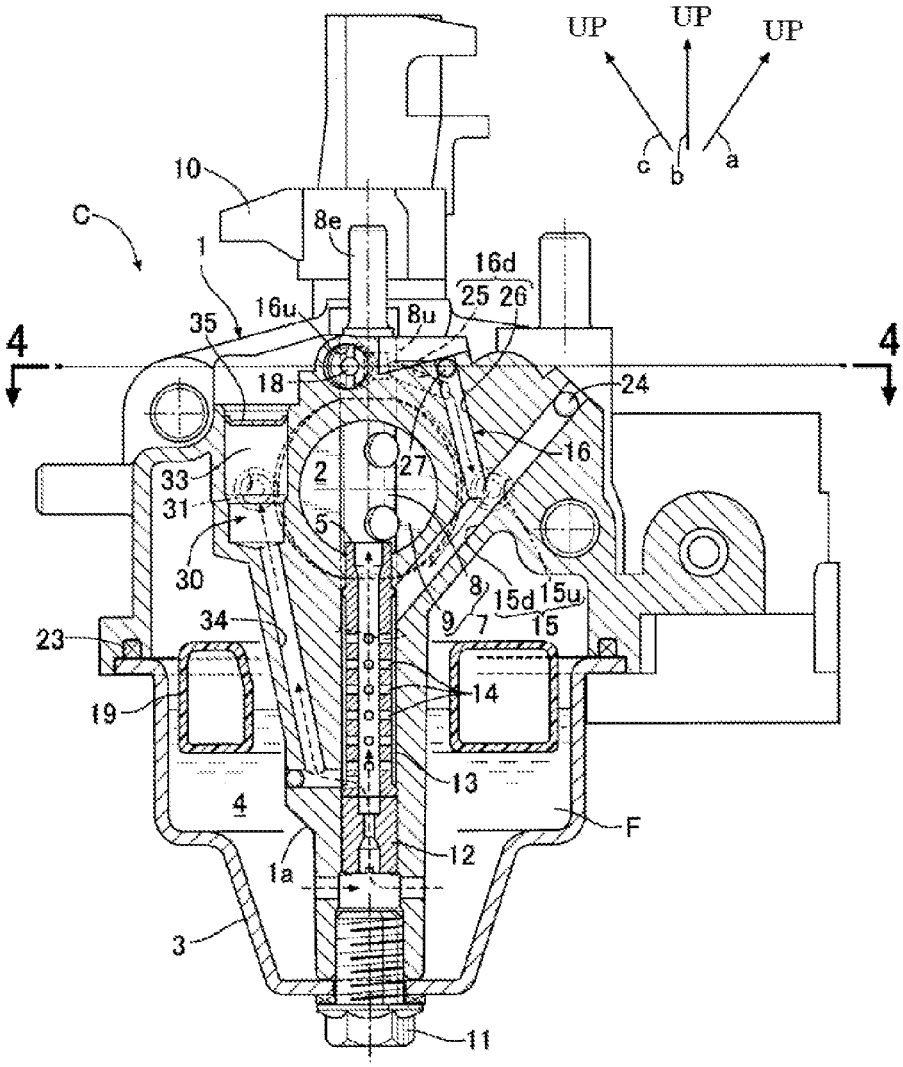
FIG. 3 is a cross-section view of the Venturi portion of the embodiment (a sectional view along the line 3-3 in FIG. 2)

As shown in FIG. 3, in the carburetor body 1, a nozzle support portion 1*a* for supporting said main nozzle 5 in the float chamber 4 extends below. A tighten bolt 11 is installed at the lower end portion of said nozzle support portion 1*a*, and the bolt 11 penetrates through the central portion of the float chamber body 3 in a liquid sealing manner, so as to fix said float chamber body 3 on the carburetor body 1. The constant amount of fuel F provided by the fuel container (not shown) is always stored in the float chamber 4, and a floater 19 for controlling open/close of the not-shown float, valve is floated in the fuel F.

Furthermore, a tighten main fuel nozzle 12 is installed on said nozzle support portion 1*a*, and said main fuel nozzle 12 enables the lower end of said main nozzle 5 to connect to said float chamber 4, thereby calculating the fuel flowing from the float chamber 4 into the main nozzle 5. Furthermore, a cylindrical air bleed chamber 13 extending in the up-and-down direction is formed between the main nozzle 5 and the nozzle support portion 1*a*, and a plurality of bleed holes 14 for connecting the air bleed chamber 13 to the main nozzle 5 are provided on peripheral walls of the main nozzle 5.

The first bleed air passage 15 in on state is formed in the carburetor body 1, and the downstream end of said first bleed air passage 15 is directly opened towards the upper portion of said air bleed chamber 13. The second bleed air passage 16 is formed in the carburetor body 1, and is opened or closed by the control valve 8*u*, and the downstream end of the second bleed air passage 16 is converged and connected to the midway portion of the downstream-side passage portion 15*d* of said first bleed air passage 15 in the carburetor body 1 each other. Thus, the downstream end of said second bleed air passage 16 is connected to the upper portion of the air bleed chamber 13 via a part (the downstream-side passage portion 15*d*) of said first bleed air passage 15.

The upstream ends of said first bleed air passage 15 and said second bleed air passage 16 are opened towards the end surfaces at the upstream side of the aspirating channel 2 in the carburetor body 1, respectively, and are directly connected to the interior of the aspirating tube P' at the upstream side. Furthermore, a tighten first air nozzle 17 for controlling the maximum air flux in said first bleed air passage 15 is installed in the upstream-side passage portion 15*u* of said first bleed air passage 15. In addition, a tighten second air nozzle 18 for controlling the maximum air flux in said second bleed air passage 16 is installed in the upstream-side passage portion 16*u* of said second bleed air passage 16.

Furthermore, the control valve that controls open/close of said second bleed air passage 16 is composed of the upper end portion 8*u* of the valve stem 8 of the throttle valve 7, as a rotation-typed control valve. Specifically, said second bleed air passage 16 is configured in such a manner that, the upper bearing hole 1*u* arranged at the upper portion of said aspirating channel 2 in the carburetor body 1 is located at the middle portion of said second bleed air passage 16, in order to enable said upper bearing hole 1*u* to support the upper end portion (i.e., the control valve 8*u*) of the valve stem 8 in a rotation-free way. Thus, said second bleed air passage 16 is distinguishably divided into the upstream-side passage portion 16*u* connected to the air cleaner via the aspirating tube P' and the downstream-side passage portion 16*d* connected to the air bleed chamber 13, by the upper bearing hole 1*u*.

Further, in the cylindrical upper end portion (i.e., the control valve 8*u*) of the valve stem 8, a slot-shaped grooving portion 22 is provided on a part of the outer periphery 8*ur* of said control valve 8*u*. When the grooving portion 22 simultaneously faces two openings 16*uo* and 16*do*, being opened towards the bearing hole 21, of the upstream-side passage portion 16*u* and the downstream-side passage portion 16*d* of said second bleed air passage 16, the grooving portion 2 causes said second bleed air passage 16 to be in the on state. Furthermore, when the grooving portion 22 only faces one of the two openings 16*uo* and 16*do*, said second bleed air passage 16 will be shut off.

Figure 4:
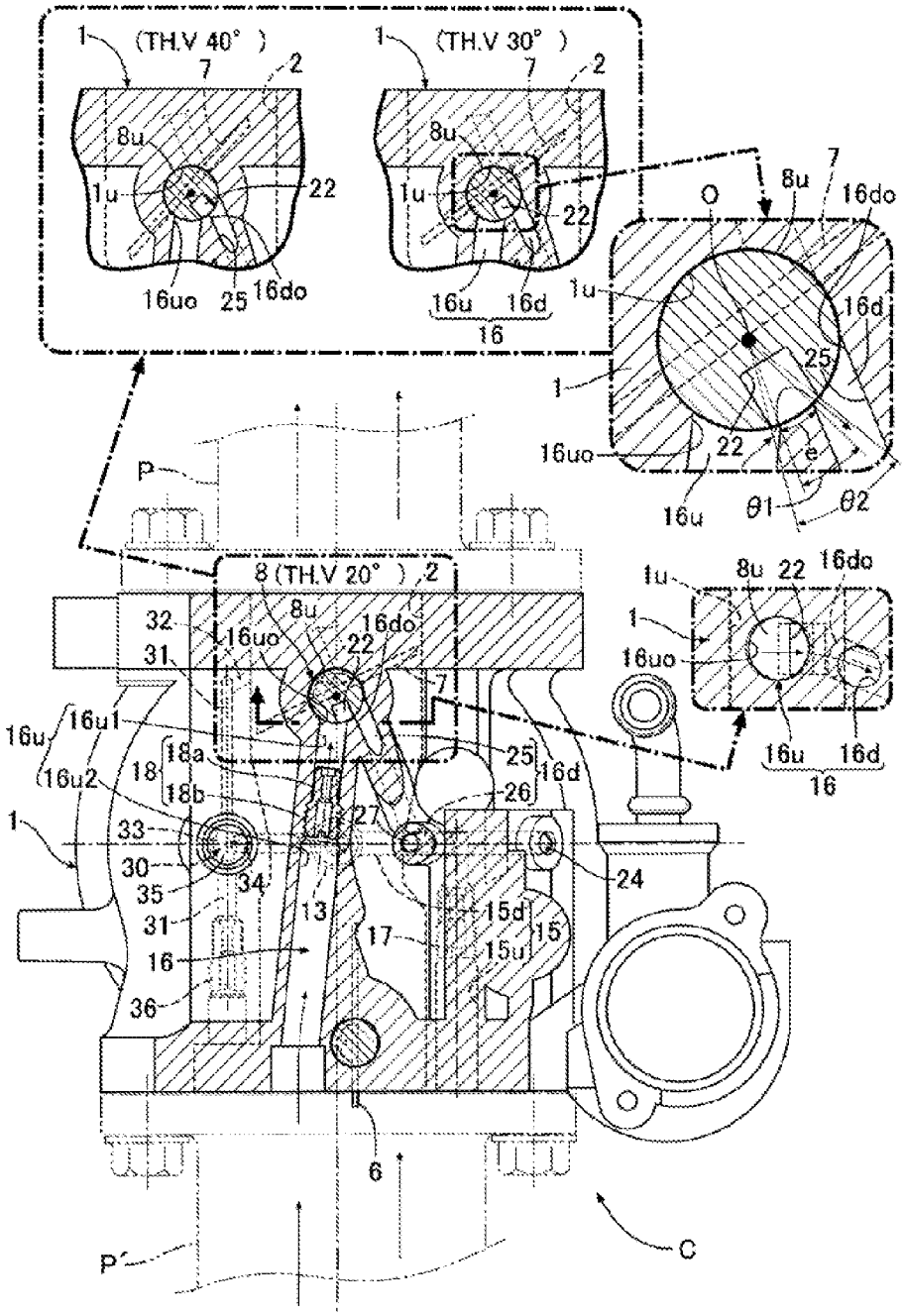
FIG. 4 is a sectional view along the line 4-4 in FIG. 3, and a partially enlarged sectional view of a state of the opening degree change in the control valve accompanying with the opening degree change in the throttle valve.

Furthermore, in the present embodiment, it can be clearly known from FIGS. 3 and 4 that the two openings 16*uo* and 16*do* of the upstream-side passage portion 16*u* and the downstream-side passage portion 16*d* of said second bleed air passage 16 are configured in such manner that, in a case of observing from a projection plane orthogonal to the valve stem 8, the two openings 16*uo* and 16*do* are arranged next to each other in the circumferential direction of said bearing hole 1*u* at a predetermined distance "e," and in an axial direction of the valve stem 8, a part of said two openings (openings 16*uo* and 16*do*) is located at the same position. Furthermore, the two openings 16*uo* and 16*do* are also formed in such manner that, both the two openings 16*uo* and 16*do* are located at the same position in the axial direction of the valve stem 8.

Furthermore, in a case of observing from the projection plane orthogonal to the valve stem 8, the central angle θ1 of the bearing hole 1*u* corresponding to the predetermined distance e is set to be an acute angle, and is smaller than the central angle θ2 of the bearing hole 1*u* corresponding to the circumferential area of the grooving portion 22. Furthermore, the grooving portion 22 is formed to be: in a case of observing from said projection plane, more concave to the center O side of the bearing hole 1*u* than the virtual straight line connected to two ends of the circumferential direction of the grooving portion 22 at the outer periphery 8*ur* of the upper end portion 8*u* of the valve stem (the transverse section in the present embodiment is an angled C-shaped slot type). In such a case, especially as stated in the present embodiment, if the grooving portion 22 is formed as the angled C-shaped slot type, the deep recess portion (i.e., the slot-shaped chamber) of said grooving portion 22 can store enough bleed air, such that the flow direction of the air entering into said recess portion from the upstream-side passage portion 16*u* of said second bleed air passage 16 or the air discharged to the downstream-side passage portion 16*d* from said recess portion is well stable, and the supply amount of the air supplied to the air bleed chamber 13 by said second bleed air passage 16 is also well stable.

As shown in FIG. 4, in the present embodiment, on one hand, the upper end portion (i.e., the control valve 8*u*) of the valve stem 8 will shut off said second bleed air passage 16, even if when the throttle valve 7 is in a predetermined low opening-degree area (e.g. a state of opening about 20 degrees relative to the plane orthogonal to an axis of the aspirating channel) from an idling opening-degree to an opening degree which is slightly larger than the idling opening-degree, and in fully-opened middle and high opening-degree areas (e.g. about 40 degrees and a state of opening more than 40 degrees); on the other hand, said second bleed air passage 16 is made to be in on-state only when the throttle valve 7 is in a specific and narrow middle opening-degree area (e.g. a state of opening 30 degrees and about 30 degrees) between said low opening-degree area and said middle and high opening-degree area.

However, as shown in the drawings, on one hand, it can be know from observing from the projection plane orthogonal to an axis of said aspirating channel 2, said first bleed air passage 15 is provided on one side (the right side in FIGS. 1 and 3) of the valve stem 8; on the other hand, the upstream-side passage portion 16*u* starting from the control valve 8*u* of said second bleed air passage 16 is provided on the upper side of said aspirating channel 2. In addition, in a case of observing from the projection plane, the downstream-side passage portion 16*d* starting from the control valve 8 of said second bleed air passage 16 is provided on one side of the valve stem 8; it can be known from observing from the projection plane, on one side of the valve stem 8, the downstream end of said downstream-side passage portion 16*d* is converged and connected to a midway portion (the middle portion of the downstream-side passage portion 15*d* as shown in the drawings) of said first bleed air passage 15.

Especially in the present embodiment, the upstream-side passage portion 15*u* of said first bleed air passage 15 is formed, by the drilling processing or the shaping processing, from the end surface at the upstream end side of the aspirating channel in the carburetor body 1 along the axis of the aspirating channel; by means of drilling downwards, the downstream-side passage portion 15*d* is formed to be opened towards the upper portion of the air bleed chamber 13 from the upper outer periphery at the right side of the carburetor body 1. The midway portion of the downstream-side passage portion 15*d* is intersected with and connected to the inner end portion of the upstream-side passage portion 15*u* formed by drilling processing or shaping processing. In such a case, the outer end of the drill for forming the downstream-side passage portion 15*d* is sealed by a stopper 24 which is fixed by closely fitting with the outer end in a liquid sealing manner.

On the other hand, the upstream-side passage portion 16*u* of said second bleed air passage 16 formed by the drilling processing or the shaping processing slightly tilts from the end surface at the upstream end side of said aspirating channel in the carburetor body 1 with respect to the axis of the aspirating channel, and is approximately formed by the drilling processing along the axis, wherein the inner end of said upstream-side passage portion 16*u* is opened towards the upper bearing hole 1*u*. In addition, the downstream-side passage portion 16*d* of said second bleed air passage 16 is formed by a first drill 25 which slightly and slowly tilts downwards and a second drill 26 which sharply tilts downwards, wherein the first drill 25 transverses the upper bearing hole 1*u* from the upper outer surface of the carburetor body 1, and extends towards the upstream side of the aspirating channel 1; the second drill 26 punches from the outer surface at the upper right of the carburetor body 1, such that the inner end of said first drill 25 is connected to the downstream-side passage portion 15*d* of said first bleed air passage 15. Furthermore, the outer end of said second drill 26 is sealed by a stopper 27 which is fixed by closely fitting with said outer end in a liquid sealing manner, while the outer end of said first drill 25 is also sealed by the stopper (not shown) in a liquid sealing manner.

Furthermore, the aperture of the upstream-side passage portion 16*u* of said second bleed air passage 16 is formed wider than the aperture of the downstream-side passage portion 16*d*, thus the width of the aperture is larger when observing from the projection plane orthogonal to the valve stem 8, and the upstream-side passage portion 16*u* is composed of a first passage portion 16*u*1 whose one end is opened towards the bearing hole 1*u*, and a second passage portion 16*u*2 which has a larger diameter and is connected to another end of said first passage portion 16*u*1 via an annular ladder portion. Furthermore, an insertion axis portion 18*a* located at the upper side of said second air nozzle 18 is inserted into the first passage portion 16*u*1, and a fixed axis portion 18*b* located at the lower side of the second air nozzle 18 and engraved with the male thread at the outer periphery is also tightened in the first passage portion 16*u*1. Similarly, the second air nozzle 18 includes a top side insertion axis portion 18*a* inserted into the upstream-side passage portion 16*u* (the first passage portion 16*u*1) of said second bleed air passage 16, and a bottom side fixed axis portion 18*b* screwedly fixed on said upstream-side passage portion 16*u*. The first passage portion 16*u*1 of the upstream-side passage portion 16*u*, into which the insertion axis portion 18*a* is inserted, is directly opened towards the bearing hole 1*u* with the same inner diameter, such that the drilling processing can be easily performed on the upstream-side passage portion 16*u* of said second bleed air passage 16.

Further, in a case of observing from the projection plane orthogonal to an axis of said aspirating channel 2, in the carburetor body 1, on the other side (the left side in FIGS. 1 and 3) of the valve stem 8 is formed with a slow passage 30 enabling a part of the storage fuel in the float chamber 4 to mix with air, so as to spray it into a location closer to the downstream than the throttle valve 7 of the aspirating channel 2. Said slow passage 30 is composed of a slow passage body 31, a slow orifice 32, a mixed chamber 33 and a slow fuel passage 34. The slow passage body 31 is formed by performing the drilling processing or the shaping processing along the axis of the aspirating channel from the end surface at the upstream end side of the aspirating channel in the carburetor body 1, the upstream end of the slow passage body 31 being opened towards interior of the aspirating tube P'; the slow orifice 32 is used as an injection orifice, one end of which is opened towards the inner end of the slow passage body 31, and another end of which is opened to a portion on the downstream side of the throttle valve 7 in the aspirating channel 2; the mixed chamber 33 is formed at the midway portion of the slow passage body 31, and has a larger volume; and the slow fuel passage 34 is used for connecting the mixed chamber 33 to the lower portion of the air bleed chamber 13. A tighten slow jet 36 for adjusting the air flow of the air passing through the slow passage body 31 is installed in the slow passage body 31. Furthermore, the mixed chamber 33 is formed by performing the drilling processing or the shaping processing on the outer surface of the carburetor body 1, wherein the opening end of the mixed chamber 33 is sealed in a liquid sealing manner by a cover 35 which is fixed by closely fitting with said opening end.

In a state where the engine operates, when the opening degree of the throttle valve 7 is the minimum idling opening degree or the low opening degree close to the minimum idling opening degree, in the slow passage 30, the air aspirated from the aspirating tube P' into the slow passage body 31 is mixed in the mixed chamber 33 together with the fuel which is discharged from the air bleed chamber 13 and is aspirated into the slow fuel passage 34, by the aspiration negative pressure generated in the aspirating channel 2 at the downstream of the throttle valve 7, and is imported into the aspirating channel 2 from the slow orifice 32, so that the necessary mixed gas can also be supplied to the aspirating channel 2 even if the engine operates in an idling state or a low load state.

The function of the present embodiment will be explained below.

When the engine operates, the amount of the aspirated air which passes through the aspirating channel 2 and is aspirated into the engine is controlled by the opening degree of the throttle valve 7, and the negative pressure generated in the Venturi portion 2*a* according to the amount of the aspirated air is applied to the main nozzle 5. Therefore, the fuel F in the float chamber 4 is sprayed from the main nozzle 5 into the aspirating channel 2 where a part of the fuel F is used to generate the mixed gas with said aspirated air, meanwhile is aspirated into the engine.

During such period, the secondary air flows into the air bleed chamber 13 through said first bleed air passage 15, and then flows into the main nozzle 5 from a plurality of bleed holes 14, wherein the fuel risen in the main nozzle 5 is emulsified to accelerate pulverization of the fuel sprayed from the main nozzle 5.

At that time, if the throttle valve 7 is in a predetermined low opening-degree area (e.g. a state of opening about 20 degrees with respect to the plane orthogonal to an axis of the aspirating channel) from an idling opening-degree to an opening degree which is slightly larger than the idling opening-degree, or is in fully-opened middle and high opening-degree areas (e.g. a state of opening more than 40 degrees), the grooving portion 22 of the control valve 8*u* of a part of the valve stem 8 only faces one of openings 16*uo* and 16*do*, being opened towards the bearing hole 1*u*, of the upstream-side and downstream-side passage portions 16*u* and 16*d* of said second bleed air passage 16, that is, the cylindrical outer periphery 8*ur* of said control valve 8*u* causes the second bleed air passage 16 to be in an OFF state. Therefore, the secondary air cannot pass through the second bleed air passage 16, and thus the amount of the air in the fuel sprayed from the main nozzle 5 is correspondingly reduced, and the mixed gas aspirated by the engine becomes denser. Therefore, when the engine operates in an idling speed or in a high load even a full load, the air-fuel ratio of the mixed gas generated by the carburetor C becomes rich oil. Thus, the operation stabilization can be realized when the engine operates in the idling speed. Moreover, when the engine operates with a high load or a full load, the output can be enhanced and knocking can be prevented from generating.

On the other hand, during the period when the throttle valve 7 is in a specific and narrow middle opening-degree area (e.g. opening in a state of 30 degrees or about 30 degrees) between said low opening-degree area and said middle and high opening-degree area, the grooving portion 22 of the control valve 8*u* is opened towards each of openings 16*uo* and 16*do*, being opened towards the bearing hole 1*u*, of the upstream-side and downstream-side passage portions 16*u* and 16*d* of said second bleed air passage 16, such that said second bleed air passage 16 becomes on state. Therefore, the secondary air can also pass through the second bleed air passage 16, and flows into the main nozzle 5 from the air bleed chamber 13 through the bleed holes 14 after converging with the secondary air passing through said first bleed air passage 15, so as to realize emulsified of the fuel sprayed from the main nozzle 5. As a result, the amount of air in the fuel sprayed from the main nozzle 5 increases, and the mixed gas aspirated by the engine is diluted to become lean oil. Therefore, reduction of the oil consumption and optimization of the bleed air can be realized when the throttle value 7 is in a specific and narrow middle opening-degree area (i.e., the engine operates with a specific load).

Furthermore, using the present embodiment, especially being loaded on the dynamic working equipment, such as a dynamic mower, an activation-typed generator, etc., the opening degree of the throttle valve 7 generally is manipulated to keep the engine run at a constant speed. In such the dynamic working equipment, during the period when the opening degree of the throttle valve 7 is manipulated to keep the engine at a constant rotation speed, the lean mixed gas can be realized by making the throttle valve 7 be in an optimized use area (the load area is recommended) in the dynamic working equipment, i.e., a specific and narrow middle opening degree area (e.g. 20 degrees to 40 degrees), thereby maintaining the lean mixed gas state persistently, reducing the oil consumption effectively and realizing optimization of the bleed air.

According to the above present embodiment, it can be known that the control valve 8*u* for opening or closing the second bleed air passage 16 is composed of a part (the upper end portion) of the valve stem 8 of the butterfly-shaped throttle valve 7. Therefore, the control valve 8*u* can be constituted by simplifying the structure without adding a specific component, and the second bleed air passage 16 can be accurately opened or closed according to the opening degree of the throttle valve 7, and thus the air-fuel ratio of the mixed gas to be used by the engine can be controlled as required.

Furthermore, in the present embodiment, in a case of observing from the projection plane orthogonal to an axis of the aspirating channel 2, the first bleed air passage 15 is provided on one side (the right side in FIGS. 1 and 3) of the valve stem 8 of the throttle valve 7, and the upstream-side passage portion 16*u* starting from the control valve 8*u* of the second bleed air passage 16 is provided on an upper side of the aspirating channel 2, the downstream-side passage portion 16*d* starting from the control valve 8*u* of the second bleed air passage 16 is provided on said one side of the valve stem 8 when observing from the projection plane, and the downstream end of the downstream-side passage portion 16*d* is connected to a midway portion of the first bleed air passage 15. Therefore, the distributed arrangement can be performed at a periphery of the aspirating channel 2 in the carburetor body 1, the first bleed air passage 15 is provided on said one side of the valve stem 8 extending in the up and down directions, and the upstream-side passage portions 16*u* of the second bleed air passage 16 is provided on the upper side of the aspirating channel 2, respectively. Such distributed arrangement not only can realize miniaturization of the carburetor body 1, but also can connect the upstream-side passage portion 16*u* of the second bleed air passage 16 to the upper end portion (i.e., the control valve 8*u*) of the valve stem 8 at a shortest distance without efforts.

Moreover, the downstream-side passage portion 16*d* of the second bleed air passage 16 is provided on one side (the right side in FIGS. 1 and 3) of the valve stem 8 in the carburetor body 1, and converges with the midway of the first bleed air passage 15 located on the same side. Therefore, it is unnecessary to make the downstream end of the second bleed air passage 16 prolong to the air bleed chamber 13, and directly open towards the air bleed chamber 13, thus the second bleed air passage 16 can be shortened, and processability and formability can be improved. Since both the upstream-side passage portion 16*u* of the second bleed air passage 16 and the control valve 8*u* connected to said upstream-side passage portion 16*u* are provided on the upper side of the aspirating channel 2, phenomena such as intrusion, attachment, deposition and so on, of dirt in the aspirating channel 2 on the control valve 8*u* caused by aspiration countercurrent or the like in the aspirating channel 2 can be prevented effectively.

Further, in the present embodiment, in a case of observing from the projection plane orthogonal to an axis of said aspirating channel 2, the slow passage 30 is provided in the carburetor body 1 on the other side (the left side in FIGS. 1 and 3) of the valve stem 8, wherein said slow passage 30 enables the fuel to be sprayed from the slow orifice 32 on the downstream side of the throttle valve 7 in the aspirating channel 2, when the throttle valve 7 is in an idling opening degree or a low opening degree close to the idling opening degree. Therefore, the slow passage 30 can be provided on another side (i.e., one side opposite to the first bleed air passage 15 across the valve stem 8) of the valve stem 8 extending in the up-and-down direction. Therefore, the slow passage 30 can be freely provided without efforts by fully using wall portions on the other side of the valve stem 8 in the carburetor body 1.

In addition, especially in the present embodiment, each of the openings 16*uo* and 16*do*, being opened towards the bearing hole 1*u*, of the upstream-side passage portion 16*u* and the downstream-side passage portion 16*d* of said second bleed air passage 16 is configured in such manner that, in a case of observing from the projection plane orthogonal to the valve stem 8, the openings 16*uo* and 16*do* are arranged next to each other in the circumferential direction of said bearing hole 1*u* at a predetermined distance e. Therefore, in a case of observing from the projection plane orthogonal to the valve stem 8, the control valve 8*u* can be opened (i.e., said grooving portion 22 faces the two openings 16*uo* and 16*do* simultaneously), only in the extremely narrow and specific opening degree area θ2−θ1 obtained by subtracting the central angle θ1 of the bearing hole 1*u* corresponding to the predetermined distance e from the central angel θ2 of the grooving portion 22, regardless of the size of the opening amplitude of the openings 16*uo* and 16*do*, and said second bleed air passage 16 can be set in on state, regardless of the size of the opening amplitude. Therefore, the structure of the carburetor C can be simplified, and the control valve 8*u* can be opened only in the narrow and specific opening degree area of the throttle valve 7, so as to adjust the gas discharge amount via the second bleed air passage 16 accurately. Using the relevant structure as the above, there is no relationship with the size of the opening amplitude of the openings 16*uo* and 16*do*. That is, the gas discharge amount can be adjusted by opening the control valve 8*u* in the narrow and specific opening degree area of the throttle valve 7. Therefore, setting of the time to open the valve cannot be influenced, large diameter of the upstream-side passage portion 16*u* of said second bleed air passage 16 can be achieved, thereby simply and reliably tighten-installing the air nozzle 18 thereon.

Since the central angle θ1 of the bearing hole 1*u* corresponding to the predetermined distance e is set to be an acute angle, the openings 16*uo* and 16*do* of the upstream-side and downstream-side passage portions 16*u* and 16*d* of said second bleed air passage 16 can be close to each other in the circumferential direction of the hearing hole 1*u*, thereby compactly and concentrately processing said second bleed air passage 16, and facilitating to realize miniaturization of the carburetor. Furthermore, in a case of observing from the projection plane orthogonal to the valve stem 8, the grooving portion 22 at the upper outer periphery 8*ur* of the valve stem 8 is formed to be more concave to the center O side of the bearing hole 1*u* than the virtual straight line connected to two ends in the circumferential direction of the grooving portion 22 at the outer periphery 8*ur*, such that the passage resistance when the bleed air passes through the control valve 8*u* (i.e., the grooving portion 22) can be reduced. Therefore, even if the valve stem 8 has some incoordination with respect to the carburetor body 1, in terms of size error and assembling error, stabilization of the air discharge amount can also be realized by controlling change in the passage resistance in the control valve 8*u* as much as possible, and the unstable situation in the set specific opening degree area caused by closing the passage can be reduced.

Furthermore, the openings 16*uo* and 16*do* opened towards the bearing hole 1*u* on said second bleed air passage 16 are configured in such a manner that, a part of the openings 16*uo* and 16*do* is located at the same position in the axial direction of the valve stem 8. Therefore, the bearing hole 1*u* and the upper end portion 8*u* of the valve stem 8 correspondingly fit with the bearing hole 1*u* can be shortened along the axial direction as much as possible, so as to realize miniaturization of the carburetor C.

One embodiment of the present invention is explained as above, but the present invention is not limited to said embodiment, which can be performed various design and change without departing from the range of the subject matter thereof.

For example, in the embodiment, it is illustrated that the control valve 8*u* for opening or closing the bleed air passage 16 is opened in the specific and narrow middle opening degree area of the throttle valve 7 (e.g. about 30 degrees). However, in the present invention, the opening degree area of the throttle valve when the control valve is opened can be arbitrarily set, which is not limited to the setting manner in the embodiment (i.e., the control valve is opened around 30 degrees). For example, the control valve can also be opened in an area in which the opening degree of the throttle valve is relatively larger, e.g. the control valve is opened in the middle and high opening degree areas (e.g. above 40 degrees).

Furthermore, the carburetor of the engine used in the dynamic working equipment is illustrated in the embodiment, but the engine which can be equipped with the carburetor stated in the present invention is not limited to the engine used in the dynamic working equipment. For example, the carburetor of the engine loaded on other vehicles including the two-wheeled motorcycle can also be applied.

In the embodiment, it is illustrated the case where the slot, in which the transverse section of the grooving portion 22 is a channel-shaped, formed on the outer periphery 8*ur* of the control valve 8*u*, but formation of the grooving portion is not limited to the embodiment, for example, it can also be a slot with a curved transverse section.

Furthermore, in the embodiment, the slow orifice 32 of the slow passage 30 is opened towards the downstream side of the throttle valve 7. However, said slow orifice 32 can also be provided between the main nozzle 5 and the throttle valve 7 in combination with the operation state, thereby adjusting the amount of the fuel sprayed into the downstream side of the throttle valve 7.

We claim:

1. A carburetor comprising:

a carburetor body;

an aspirating channel disposed in the carburetor body;

a butterfly throttle valve disposed in the aspirating channel, the butterfly throttle valve opening or closing the aspirating channel, the throttle valve including a valve stem being rotatably supported by the carburetor body, the valve stem extending in up and down direction;

a main nozzle disposed in the carburetor body and being opened to the aspirating channel;

an air bleed chamber disposed at an outer periphery of the main nozzle and communicating to an interior of the main nozzle via a plurality of bleed holes;

a first bleed air passage disposed in the carburetor body and remaining in an opened state, the first bleed air passage being connected to the air bleed chamber, the first bleed air passage including an upstream end thereof being opened to a portion of the carburetor body located on an upstream side of the aspirating channel;

a second bleed air passage disposed in the carburetor body and opened or closed by a control valve, the second bleed air passage being connected to the air bleed chamber, the second bleed air passage including an upstream end thereof being opened to a portion of the carburetor body located on the upstream side of the aspirating channel; and a float chamber connected to the carburetor body and storing storage fuel capable of being sprayed into said aspirating channel through said main nozzle, wherein the control valve is a rotary valve including an end portion of the valve stem, the end portion of the valve stem including a grooving portion on an outer surface thereof such that the end portion opening and closing the second bleed air passage according to an opening degree of said throttle valve, the end portion of the valve stem is an upper end portion of the valve stem, in a projection plane orthogonal to an axis of said aspirating channel, the first bleed air passage is arranged on one side of said valve stem, the second bleed air passage includes an upstream-side passage portion defined by a portion of the second bleed air passage located on an upstream side of the control valve, the upstream-side passage portion being disposed above said aspirating channel, the second bleed air passage includes a downstream-side passage portion defined by a portion of the second bleed air passage located on a downstream side of the control valve, the downstream-side passage portion being disposed on the one side of the valve stem, and a downstream end of said downstream-side passage portion is connected to a midway portion of said first bleed air passage.

2. The carburetor according to claim 1, further comprising a slow passage disposed in the carburetor body on the other side of the valve stem in the projection plane orthogonal to the axis of said aspirating channel, the slow passage enabling a part of the storage fuel in the float chamber to mix with air and to be sprayed into the aspirating channel, wherein the slow passage includes an injection orifice opened at a portion of the aspirating channel located on a downstream side of the main nozzle.

3. The carburetor according to claim 1, wherein the carburetor body includes a bearing hole being fitted with and supporting rotatably the upper end portion of the valve stem, wherein said upstream-side passage portion and said downstream-side passage portion of said second bleed air passage are opened at said bearing hole such that an opening of said upstream-side passage portion at the bearing hole and an opening of said downstream-side passage portion at the bearing hole are arranged next to each other in a circumferential direction of said bearing hole in a projection plane orthogonal to said valve stem, and the openings are at least partially located at the same position along an axis direction of said valve stem.

4. The carburetor according to claim 3, wherein the grooving portion of the valve stem has a width wider than a distance between the opening of said upstream-side passage portion at the bearing hole and the opening of said downstream-side passage portion at the bearing hole in the projection plane orthogonal to the valve stem.

* * * * *